US006116799A

United States Patent [19]

Kageyama

[11] Patent Number: 6,116,799

[45] Date of Patent: Sep. 12, 2000

[54] INSTALLATION STRUCTURE OF LEAD ADVANCING MECHANISM IN WRITING INSTRUMENT

[75] Inventor: Hidehei Kageyama, Kawagoe, Japan

[73] Assignee: Kotobuki & Co., Ltd., Kyoto, Japan

[21] Appl. No.: 09/195,693

[22] Filed: Nov. 19, 1998

[51] Int. Cl.[7] ..... B43K 21/16

[52] U.S. Cl. ..... 401/65; 401/92

[58] Field of Search ..... 401/65, 67, 92, 401/93, 94, 55

[56] References Cited

U.S. PATENT DOCUMENTS

| | | | |
|---|---|---|---|
| 4,452,544 | 6/1984 | Sumita | 401/65 |
| 4,620,811 | 11/1986 | Kageyama | 401/65 |
| 4,714,365 | 12/1987 | Kageyama et al. | 401/65 |
| 5,009,533 | 4/1991 | Kageyama . | |
| 5,733,057 | 3/1998 | Noguchi | 401/65 |

*Primary Examiner*—David J. Walczak
*Attorney, Agent, or Firm*—McGinn & Gibb, P.C.

[57] ABSTRACT

An installation structure for a writing instrument includes an outer cylinder and a lead advancing mechanism, which is housed in the outer cylinder and has a sleeve provided with a protruding portion protruding in the outward direction, for advancing a lead by a predetermined amount. The lead advancing mechanism is installed in the outer cylinder so as to prevent the lead advancing mechanism from coming off (e.g., decoupling from) the outer cylinder by making the front end of the sleeve abut a step portion formed on the inner peripheral surface of the outer cylinder and fixing the protruding portion provided on the sleeve to a second step portion formed on the inner peripheral surface of the outer cylinder.

20 Claims, 4 Drawing Sheets

INSTALLATION STRUCTURE OF LEAD ADVANCING MECHANISM IN WRITING INSTRUMENT

BACKGROUND OF THE INVENTION

1. Field of the Invention

The present invention generally relates to an installation structure for installing a lead advancing mechanism for advancing a lead by a predetermined amount, in an outer cylinder of a writing instrument (e.g., a mechanical pencil).

2. Description of the Related Art

A conventional writing instrument has been disclosed in, for example, Published Unexamined Utility Model Application No. 61-37990 or Published Unexamined Utility Model Application No. 61-40284.

In a writing instrument (e.g., mechanical pencil) disclosed in these Publications, a lead advancing mechanism housed in an outer cylinder has a lead pipe, a chick fixed at the front end of the lead pipe, a chuck ring fitted outside a head of the check to tighten the head of the chuck, a stopper abutting the read end of the chuck ring, and a chuck spring inserted between the front end of the lead pipe and the front end portion of the stopper to normally urge the chuck to the rear in the axial direction via the lead pipe. A stopper fixing hole is formed in the peripheral surface of the outer cylinder. By fixing a stopper protrusion of the stopper of the lead advancing mechanism in the stopper fixing hole, the lead advancing mechanism is installed in the outer cylinder without decoupling from (e.g., coming off) the outer cylinder.

However, in the installation of such a conventional lead advancing mechanism, the stopper fixing hole must be formed in the outer peripheral surface of the outer cylinder, and is visible from the outside, Thus, the writing instrument's appearance is poor. Therefore, another part must be provided on the outer peripheral surface of the outer cylinder to make the stopper fixing hole invisible from the outside.

Also, in assembly, the stopper protrusion must be brought to the stopper fixing hole by moving the lead advancing mechanism including the stopper in the outer cylinder. When the stopper protrusion protruding in the outward direction is moved in the outer cylinder, a large resistance is exerted by the inner peripheral surface of the outer cylinder, so that the operation is slow, or the inner peripheral surface of the outer cylinder may be damaged.

SUMMARY OF THE INVENTION

In view of the foregoing and other problems of the conventional methods and structures, an object of the present invention is to provide an installation structure which installs a lead advancing mechanism in an outer cylinder without marring the appearance of the outer cylinder.

To achieve the above object, a protruding portion protruding in the outward direction is provided on a sleeve of the lead advancing mechanism. The sleeve is fixed on the inner peripheral surface of the outer cylinder by using the protruding portion, by which the lead advancing mechanism is installed in the outer cylinder so as to prevent the lead advancing mechanism from decoupling from the outer cylinder.

Since the sleeve of the lead advancing mechanism is merely fixed on the inner peripheral surface of the outer cylinder, the lead advancing mechanism is installed in the outer cylinder without marring the appearance of the outer cylinder.

Also, as a mechanism for fixing the sleeve of the lead advancing mechanism on the inner peripheral surface of the outer cylinder, the protruding portion provided on the sleeve can be fixed on the inner peripheral surface of the outer cylinder.

Also, as a mechanism for fixing the sleeve of the lead advancing mechanism on the inner peripheral surface of the outer cylinder, the front end of the sleeve can be made to abut on a step portion formed on the inner peripheral surface of the outer cylinder, and the protruding portion provided on the sleeve can be fixed to a second portion formed on the inner peripheral surface of the outer cylinder.

When the lead advancing mechanism is inserted into the outer cylinder from the rear to assemble the outer cylinder, the protruding portion of the sleeve can move smoothly in the outer cylinder until the protruding portion reaches the second step portion, and meets with resistance only when the protruding portion travels over the second step portion. After traveling over the second step portion, the protruding portion of the sleeve is fixed to the second step portion.

The protruding portion of the sleeve may be formed of a plurality of protrusions, or by a single annular protrusion formed on the outer peripheral surface of the sleeve. Alternatively, the protruding portion can be formed of at least one protrusion spreading out in the outward direction at the rear end of the sleeve.

In another aspect of the invention, the lead advancing mechanism may include a lead tank, a chuck whose rear end is fixed to the front end of the lead tank, a chuck ring fitted outside a head of the chuck to tighten the head of the chuck, the sleeve abutting on the read end of the chuck ring, and a chuck spring inserted between the front end of the lead tank and the front end portion of the sleeve to normally urge the chuck rearwardly in the axial direction via the lead tank.

Also, the second step portion formed on the inner peripheral portion of the outer cylinder, to which the protruding portion of the sleeve is fixed, includes an undercut portion, and the outer cylinder is molded by forcibly drawing a core pin.

With the unique and unobvious structure of the present invention, the writing instrument has an aesthetically pleasing appearance and the assembly operation is efficiently performed.

BRIEF DESCRIPTION OF THE DRAWINGS

The foregoing and other purposes, aspects and advantages will be better understood from the following detailed description of preferred embodiments of the invention with reference to the drawings, in which.

DETAILED DESCRIPTION OF PREFERRED EMBODIMENT OF THE INVENTION

Figure 1:
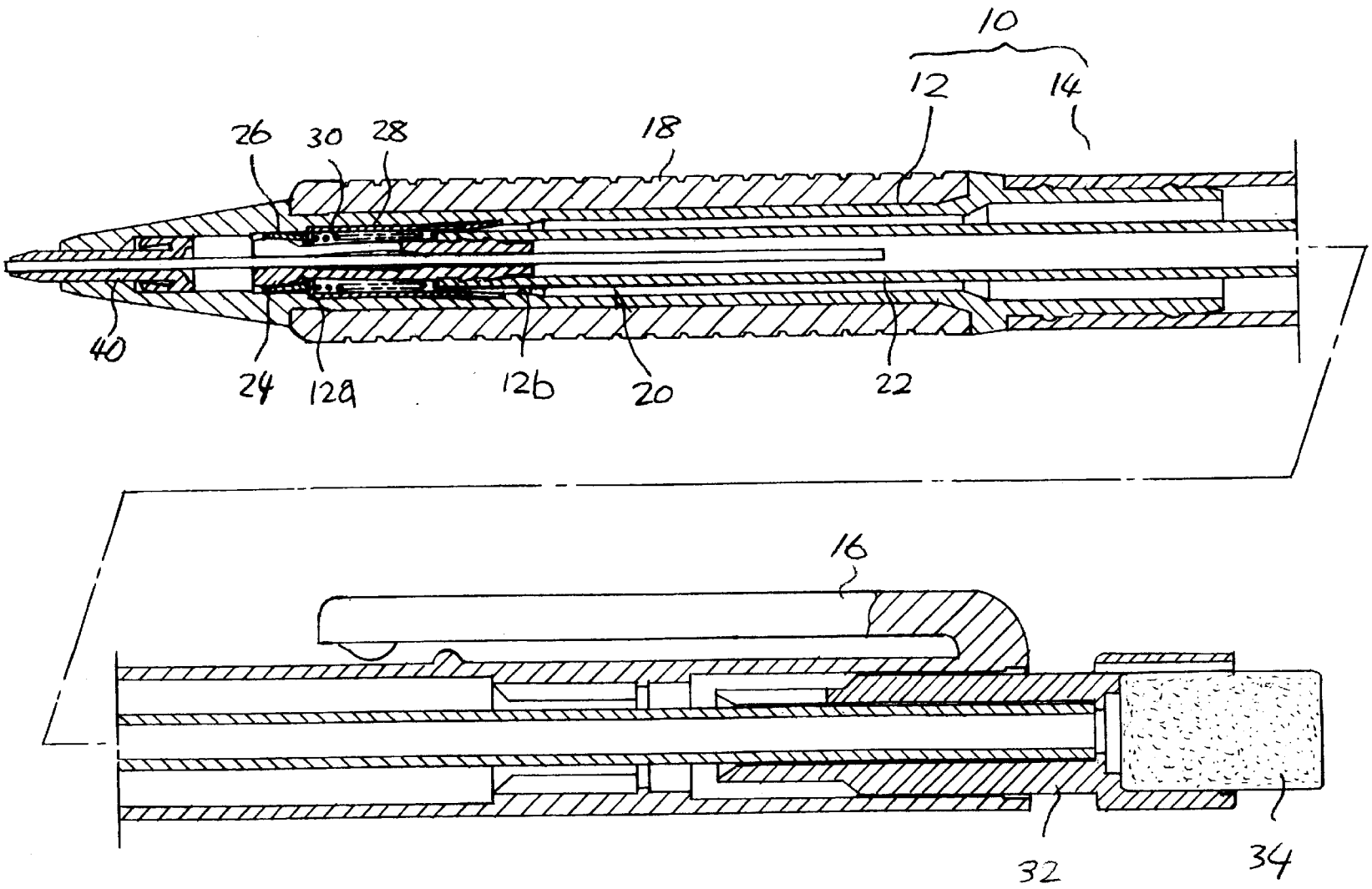
FIG. 1 is a longitudinal sectional view showing a first preferred embodiment of an installation structure in accordance with the present invention for installing a lead advancing mechanism in an outer cylinder in a writing instrument (e.g., mechanical pencil)
Figure 2:
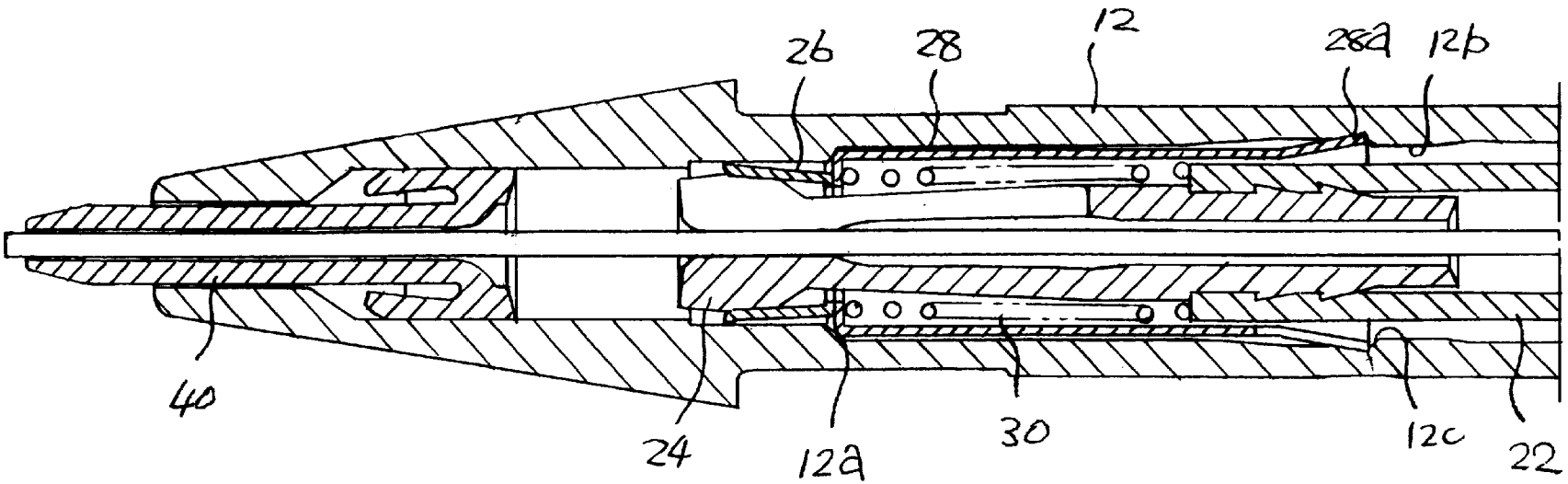
FIG. 2 is an enlarged longitudinal sectional view of a principal portion of FIG. 1.

Referring now to the drawings, and more particularly to FIGS. 1–6, there is shown a preferred embodiment according to the present invention.

As shown in FIG 1, an outer cylinder 10 of a writing instrument (e.g., a mechanical pencil) includes a front cylinder 12 and a rear cylinder 14 integrally formed with a clip 16.

The outer cylinder 10 can be made up of a plurality of parts as shown in FIG. 1. Further, the front cylinder 12 and a front nose can be made as separate parts, and can be included in the outer cylinder 10. Alternatively, the outer cylinder 10 can be a single integrated part. The front cylinder 12 and the rear cylinder 14 are preferably connected together by press fitting. Of course, the cylinders 12, 14 can be connected by any other connecting method such as by screwing, bonding and the like. An elastic body 18, preferably made of rubber or a like material, is formed at the outer periphery of the front cylinder 12. The elastic body 18 functions as an anti-slip means for being grasped by a user's fingers.

The outer cylinder 10 houses a lead advancing mechanism 20. The lead advancing mechanism 20 includes a lead tank 22, a chuck 24 having a rear end fixed to the front end of the lead tank 22, a chuck ring 26 fitted outside ahead of the chuck 24 to tighten the chuck head, a sleeve 28 abutting the rear end of the chuck ring 26, a chuck spring 30 inserted between the front end of the lead tank 22 and the front end portion of the sleeve 28 to normally urge the chuck 24 rearwardly in the axial direction via the lead tank 22, an eraser bearer 32 removably fitted at the rear end portion of the lead tank 22, and an eraser 34 held by the eraser bearer 32.

A front end pipe 40 is disposed in the front cylinder 12 of the outer cylinder 10, so as to be movable in the axial direction. The rear portion of the front end pipe 40 abuts elastically on the inner peripheral surface of the front cylinder 12.

Figure 3:
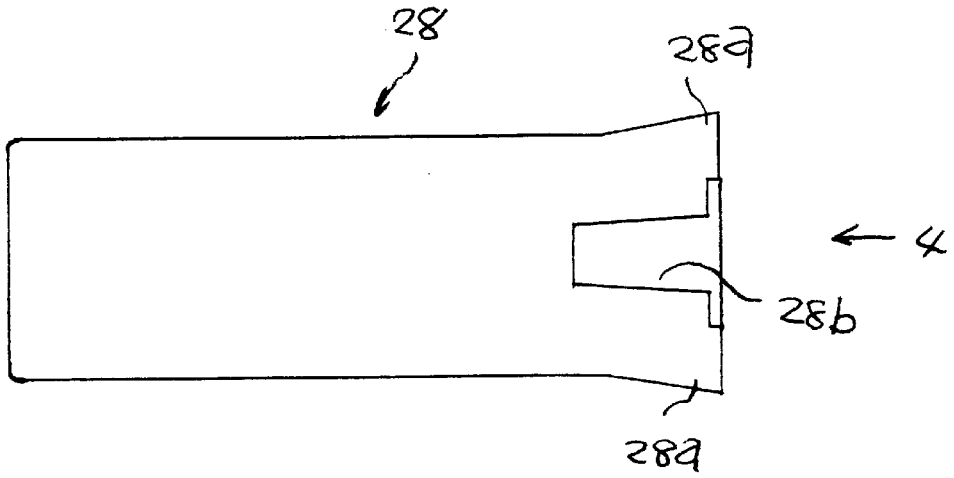
FIG. 3 is a side view of a sleeve 28 shown in FIG. 1.
Figure 4:
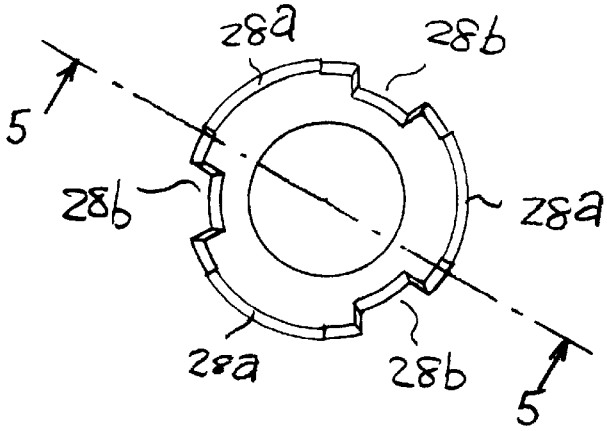
FIG. 4 is a view taken in the direction of an arrow 4 of FIG. 3.
Figure 5:
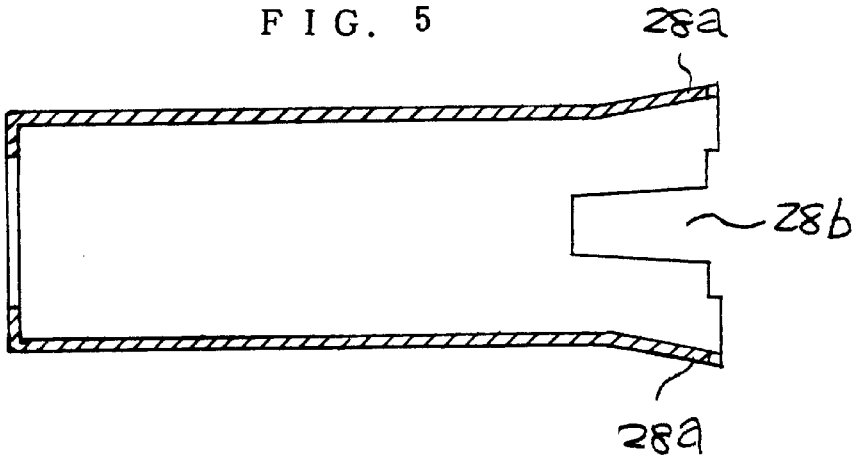
FIG. 5 is a sectional view taken along the line 5—5 of FIG. 4.

The sleeve 28 of the lead advancing mechanism 20 preferably is made of metal. As shown in FIGS. 3 to 5, a plurality (e.g., three in the non-limiting example shown in the figures) of protrusions 28*a* (e.g., protruding portions) are formed spreading out (e.g., fanning out) in the outward direction at the rear end of the sleeve 28, and slits 28*b* are formed between the adjacent protrusions 28*a*.

Figure 6:
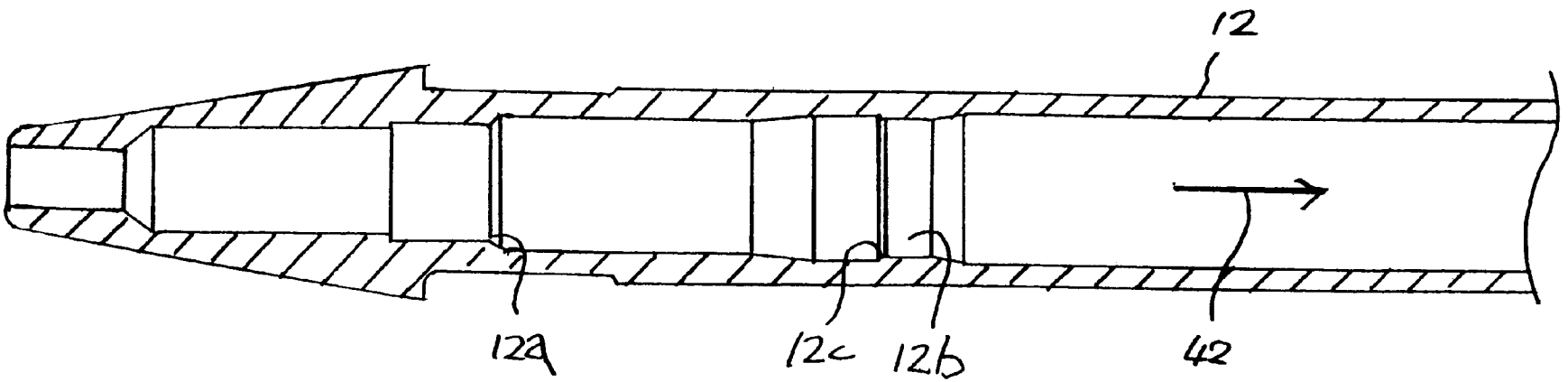
FIG. 6 is a longitudinal sectional view of a front cylinder 12 shown in FIG. 1.

A plurality of step portions 12*a*, 12*b* are formed on the inner peripheral surface of the front cylinder 12 of the outer cylinder 10 (e.g., see FIG. 6). The front end of the sleeve 28 abuts a step portion 12*a* formed at the front of the substantially central portion in the axial direction of the front cylinder 12, and the tip ends of the protrusions 28*a* of the sleeve 28 are caught (e.g., somewhat cutting into or impeded by the front cylinder) by a second step portion 12*b* at the rearward position of the step portion 12*a*, by which the sleeve 28 is fixed to the outer cylinder 10. The second step portion 12*b* projects annularly from the inner peripheral surface of the front cylinder 12. The portion where the protrusions 28*a* of the sleeve 28 are fixed is an undercut portion 12*c*. At the undercut portion 12*c*, the inside diameter decreases gradually toward the rear.

Thus, in molding the front cylinder 12, a forcible draw (e.g., indicated by an arrow 42 in FIG. 6) of a core pin at a portion corresponding to the undercut portion 12*c* can be performed smoothly and reliably. The second step portion 12*b* is not limited to an annularly projecting portion. For example, a step portion projecting discretely around the circumference may be used if the step portion can fix the protruding portions of the sleeve 28.

Thus, by fixing the sleeve 28 to the outer cylinder 10, the lead advancing mechanism 20 is reliably installed to the outer cylinder 10 without falling off (e.g., decoupling).

When the mechanical pencil is assembled, the lead advancing mechanism 20 is assembled beforehand by inserting the chuck 24 from the front end portion of the sleeve 28 in a state in which the chuck spring 30 is inserted in the sleeve 28 and the chuck ring 26 is fitted outside the head of the chuck 24. The rear end of the chuck 24 is fixed to the front end of the lead tank 22 by press fitting or by other means. The front end pipe 40 is inserted from the rear of the outer cylinder 10 (or the front cylinder 12), and then the lead advancing mechanism 20 is inserted.

At this time, although the protrusions 28*a* of the sleeve 28 protrude in the outward direction, the protrusions 28*a* do not abut heavily on the inner peripheral surfaces of the rear cylinder 14 and the front cylinder 12, and therefore do not meet with a large resistance until the protrusions 28*a* reach the second step portion 12*b*.

When the protrusions 28*a* reach the second step portion 12*b*, the protrusions 28*a* are deflected in the inward direction by the slits 28*b* formed adjacent to the protrusions 28*a*, travel (e.g. slide) over the second step portion 12*b*, and are caught by the undercut portion 12*c* of the second step portion 12*b*, cutting somewhat into the front cylinder 12. Thus, the protrusions 28*a* exert a force on the inner peripheral walls of the front cylinder 12 at the area of the undercut portion 12*c* (e.g., see FIG. 2).

Thus, the assembly can be completed merely by pushing the lead advancing mechanism 20 into the outer cylinder 10 from the rear. Since the inner peripheral surface of the outer cylinder 10 will not be damaged by the protrusions 28*a* of the sleeve 28, even if the outer cylinder 10 is made transparent, flaws cannot be detected readily externally. At most, flaws may develop by friction when the protrusions 28*a* slide over (e.g., travel over) the second step portions 12*b*. However, since the second step portion 12*b* projects inwardly, the flaws are inconspicuous from the outside.

In writing, as is well known, the eraser bearer 32, which is located at the rear end of the lead advancing mechanism 20 so as to project from the outer cylinder 10, is knocked (e.g., depressed, actuated, etc.) Then, the chuck 24 is knocked via the lead tank 22, so that the lead is let out by a predetermined amount and pushed out forwardly through the front end pipe 40 from the front cylinder 12. Thus, writing can be performed.

As shown in this exemplary non-limiting embodiment, the sleeve 28 is made of metal, and the protruding portions can be formed by using a jig or by beading.

Further, when the sleeve 28 is made of metal, the sleeve 28 can be fixed firmly by making the protruding portions 28*a* of the sleeve 28 cut completely into the inner peripheral surface of the front cylinder 12 instead of providing the second step portion 12*b* of the front cylinder 12. Hence, because the sleeve 28 is moved to the fixing location on the inner peripheral surface of the outer cylinder 10, flaws may develop on the inner peripheral surface of the outer cylinder 10 (e.g., front cylinder 12). However, the second step portion 12*b* need not be provided on the front cylinder 12, so that the undercut portion 12*c* need not exist. Therefore, in molding the front cylinder 12, forcible draw of a core pin need not be performed. Also, the front cylinder 12 can be extrusion-molded.

Alternatively, the sleeve 28 can be made of synthetic resin, and the protrusions 28*a* can be made as flexible protruding portions. Since the protrusions have flexibility, when an excessive wiring pressure is exerted, the protrusions deflect to relieve the excessive wiring pressure.

While the invention has been described in terms of a preferred embodiment, those skilled in the art will recognize that the invention can be practiced with modification within the spirit and scope of the appended claims.

For example, while the embodiment above has been described in relation to a mechanical pencil, other writing instruments utilizing a different lead (e.g., different than lead) also would find great benefit with the invention.

What is claimed is:

1. An installation structure of a lead advancing mechanism for a mechanical pencil, comprising:

an outer cylinder provided with a first protruding portion inwardly protruded in a radial direction on an inner peripheral surface thereof, said first protruding portion having an undercut portion;

a lead advancing mechanism, housed in said outer cylinder, including a sleeve provided with a second protruding portion outwardly protruded in a radial direction, for advancing a lead by a predetermined amount; and a fixing device for fixing said sleeve on an inner peripheral surface of said outer cylinder by fixing the second protruding portion of said sleeve to the undercut portion of the first protruding portion of the outer cylinder, said outer cylinder having a rear portion behind said first protruding portion, through which said sleeve with said second protruding portion smoothly passes during assembly.

2. The installation structure according to claim 1, wherein said lead advancing mechanism is installed in said outer cylinder by using said fixing device to prevent said lead advancing mechanism from decoupling from said outer cylinder.

3. The installation structure according to claim 2, wherein the fixing device makes a front end of said sleeve abut a step portion formed on the inner peripheral surface of said outer cylinder, and fixed the second protruding portion of said sleeve to the undercut portion of the first protruding portion of said outer cylinder.

4. The installation structure according to claim 3, wherein a portion of said first protruding portion provided on the inner peripheral surface of said outer cylinder where the second protruding portion of said sleeve is fixed, comprises said undercut portion, and said outer cylinder is molded by forcibly drawing a core pin.

5. The installation structure according to claim 2, wherein the second protruding portion comprises at least one protrusion spreading out in an outward direction at a rear end of said sleeve.

6. The installation structure according to claim 2, wherein said lead advancing mechanism comprises:

a lead tank;

a chuck having a rear end fixed to the front end of said lead tank;

a chuck ring fitted outside a head of said chuck to tighten the head of said chuck, said sleeve abutting the rear end of said chuck ring; and a chuck spring inserted between the front end of said lead tank and the front end portion of said sleeve to normally urge said chuck rearwardly in the axial direction via said lead tank.

7. The installation structure according to claim 1, wherein said outer cylinder is formed devoid of engaging holes.

8. A writing instrument, comprising:

an outer cylinder provided with a first protruding portion inwardly protruded in a radial direction on an inner peripheral surface thereof, said first protruding portion having an undercut portion;

a lead advancing mechanism, housed in said outer cylinder, including a sleeve provided with a second protruding portion outwardly protruded in a radial direction, for advancing a lead by a predetermined amount; and a fixing device for fixing said sleeve on an inner peripheral surface of said outer cylinder by fixing the second protruding portion of said sleeve to the undercut portion of the first protruding portion of the outer cylinder, said outer cylinder having a rear portion behind said first protruding portion, through which said sleeve with said second protruding portion smoothly passes during assembly, and said lead advancing mechanism being installed in said outer cylinder by using said fixing device to prevent said lead advancing mechanism from decoupling from said outer cylinder.

9. The writing instrument according to claim 8, wherein said fixing device makes a front end of said sleeve abut a step portion formed on the inner peripheral surface of said outer cylinder, and fixes the second protruding portion of said sleeve to the undercut portion of the first protruding portion of said outer cylinder.

10. The writing instrument according to claim 9, wherein a portion of said first protruding portion provided on the inner peripheral surface of said outer cylinder where said second protruding portion of said sleeve is fixed, comprises an undercut portion, and said outer cylinder is molded by forcibly drawing a core pin.

11. The writing instrument according to claim 8, wherein said second protruding portion comprises at least one protrusion spreading out in an outward direction at a rear end of said sleeve.

12. The writing instrument according to claim 8, wherein said lead advancing mechanism comprises:

a lead tank;

a chuck having a rear end fixed to the front end of said lead tank;

a chuck ring fitted outside a head of said chuck to tighten the head of said chuck, said sleeve abutting the read end of said chuck ring; and a chuck spring inserted between the front end of said lead tank and the front end portion of said sleeve to normally urge said chuck rearwardly in the axial direction via said lead tank.

13. The writing instrument according to claim 8, wherein said outer cylinder is formed devoid of engaging holes.

14. An installation structure of a lead advancing mechanism for a mechanical pencil, comprising:

an outer cylinder;

a lead advancing mechanism, housed in said outer cylinder, including a sleeve made of metal and provided with a protrusion member in the outward direction, for advancing a lead by a predetermined amount; and a fixing device for fixing said sleeve on an inner peripheral surface of said outer cylinder by cutting the protrusion member of said metal sleeve into the inner peripheral surface of said outer cylinder.

15. The installation structure according to claim 14, wherein the lead advancing mechanism is installed in said outer cylinder by using said fixing device to prevent said lead advancing mechanism from decoupling from said outer cylinder.

16. The installation structure according to claim 15, wherein said fixing device fixes the protrusion provided on said sleeve on the inner peripheral surface of said outer cylinder.

17. The installation structure according to claim 15, wherein said fixing device makes a front end of said sleeve abut a step portion formed on the inner peripheral surface of said outer cylinder, and cuts the protrusion member provided on said sleeve into the inner peripheral surface of said outer cylinder.

18. The installation structure according to claim 17, wherein a portion of said second step formed on the inner peripheral surface of said outer cylinder where the protrusion member of said sleeve is fixed, comprises an undercut portion, and said outer cylinder is molded by forcibly drawing a core pin.

19. The installation structure according to claim 15, wherein the protrusion member comprises at least one protrusion spreading out in an outward direction at a rear end of said sleeve.

20. The installation structure according to claim 15, wherein said lead advancing mechanism comprises:

a lead tank;

a chuck having a rear end fixed to the front end of said lead tank;

a chuck ring fitted outside a head of said chuck to tighten the head of said chuck, said sleeve abutting the rear end of said chuck ring; and a chuck spring inserted between the front end of said lead tank and the front end portion of said sleeve to normally urge said chuck rearwardly in the axial direction via said lead tank.

* * * * *